US005744738A

United States Patent [19]

Gatzen

[11] Patent Number: 5,744,738

[45] Date of Patent: Apr. 28, 1998

[54] FRAME STRUCTURE FOR MUSICAL DRUMS

[76] Inventor: Robert A. Gatzen, 157 Pheasant Run, Newington, Conn. 06111

[21] Appl. No.: 526,154

[22] Filed: Sep. 11, 1995

[51] Int. Cl.[6] ..... G10D 13/02

[52] U.S. Cl. ..... 84/421; 84/DIG. 12; 248/124.1

[58] Field of Search ..... 84/421, 453, 170, 84/DIG. 12, 122.1, 124.1, 125.1, 125.8

[56] References Cited

U.S. PATENT DOCUMENTS

| | | | |
|---|---|---|---|
| 1,774,744 | 9/1930 | Cenci | 84/170 |
| 2,505,882 | 5/1950 | Cassato | 84/421 |
| 4,691,611 | 9/1987 | May | 84/421 |
| 5,161,761 | 11/1992 | May | 84/421 |
| 5,531,148 | 7/1996 | Wilson | 84/421 |

OTHER PUBLICATIONS

Wexler Catalog, Chicago IL 1965 pp. 244–245.

*Primary Examiner*—Cassandra C. Spyrou
*Attorney, Agent, or Firm*—Kokjer, Kircher, Bowmann & Johnson

[57] ABSTRACT

A rigid frame provides a mount for musical drums and cymbals as well as a seat for a drummer to provide him with vibrational feedback from the drums. The seat is adjustable and accommodates the drummer in a recumbent position. Sidewardly extending wings on the frame accommodate a special mounting arrangement for a bass drum. An upwardly extending post on the frame mounts an acoustical drum and a high hat cymbal. A snare drum is mounted in front of the seat on a telescopically adjustable double rail structure which is supported on front and back legs.

19 Claims, 4 Drawing Sheets

FRAME STRUCTURE FOR MUSICAL DRUMS

FIELD OF THE INVENTION

This invention relates generally to the field of musical drums and more particularly to a frame which provides a seat for a drummer as well as a means for mounting drums and accessories such as cymbals.

BACKGROUND OF THE INVENTION

Drummers typically play their instruments while sitting on a stool which stands on the stage. Each different drum and accessory is separately mounted on the stage as a stand alone device. This conventional drum arrangement has been less than satisfactory in a number of respects.

For one thing, the back of the drummer is subjected to considerable stress. While playing, the drummer is constantly reaching forward from his seat on a level seating surface. Ergonomic studies have established that this position causes the back to arch and tends to place undue strain on both the upper and lower back regions as well as the shoulders. The pressure on the disks can cause chronic back problems along with fatigue, reduced trunk control, poor circulation, reduced sensitivity of extremities (such as fingers, wrists, feet and ankles), and a decrease in the musical performance level.

The physical separation of the drummer seated on his stool from the instruments also detracts from the "feel" of the drummer and the feedback he receives from the instruments he is playing. The vibration of the drums is not sensed well by the drummer because the drums are physically isolated from the body of the drummer. His only physical contact with the drums occurs when he is actually striking the drumhead.

SUMMARY OF THE INVENTION

The present invention is directed to an improved drum assembly which is specially constructed to overcome the problems that plague a conventional drum set up. It is a particularly important object of the invention to provide a drum assembly having a rigid frame that presents both a seat for the drummer and a mounting system for the drums and relates components. The result is that the vibrational energy of the drums is transmitted through the frame to the seat where the drummer receives vibrational feedback giving him an enhanced "feel" for his playing and a better appreciation for the sounds the drums are making. The vibrational energy is also shared by each of the drum components. This shared vibrational energy places the acoustic drums in an "idle" condition which increases their dynamic sensitivity to improve the drum performance.

Another important object of the invention is to provide a drum assembly in which the drummer assumes a recumbent position while playing the drums. The recumbent position is more comfortable and applies less strain on the back and other parts of the body. This improved ergonomic effect results in a better musical performance and fewer physical problems than in the case where the drummer sits in a conventional position. The invention is also characterized by a quick and easy adjustment of the tilt angle of the seat so that it can be positioned to comfortably accommodate drummers of different sizes and builds.

A further object of the invention is to provide a drum assembly having a frame to which virtually any type of drum or drum accessory can be mounted. The frame has a telescopic double rail structure to which the drums are mounted. For example, tom-toms and a cymbal can be mounted to a post which extends upwardly from the rail. A snare drum can be mounted to the rail directly in front of the seat. A bass drum can be mounted to the rail through a special mounting assembly which is another important feature of the invention. On the side opposite the bass drum, a pedal operated cymbals set can be mounted to the rail.

Still another object of the invention is to provide a drum assembly which can be quickly and easily set up and taken down and which is constructed to assume a compact configuration for storage and shipping.

A still further object of the invention is to provide a drum assembly of the character described which is aesthetically pleasing, economical to construct, and which includes numerous adjustments to provide a customized arrangement tailored to comfortably accommodate the needs of each different drummer. This feature adds precision and repeatability of the adjustments, thus allowing customized drum configurations to be set up the same way each time without variations.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figures 1, 8:
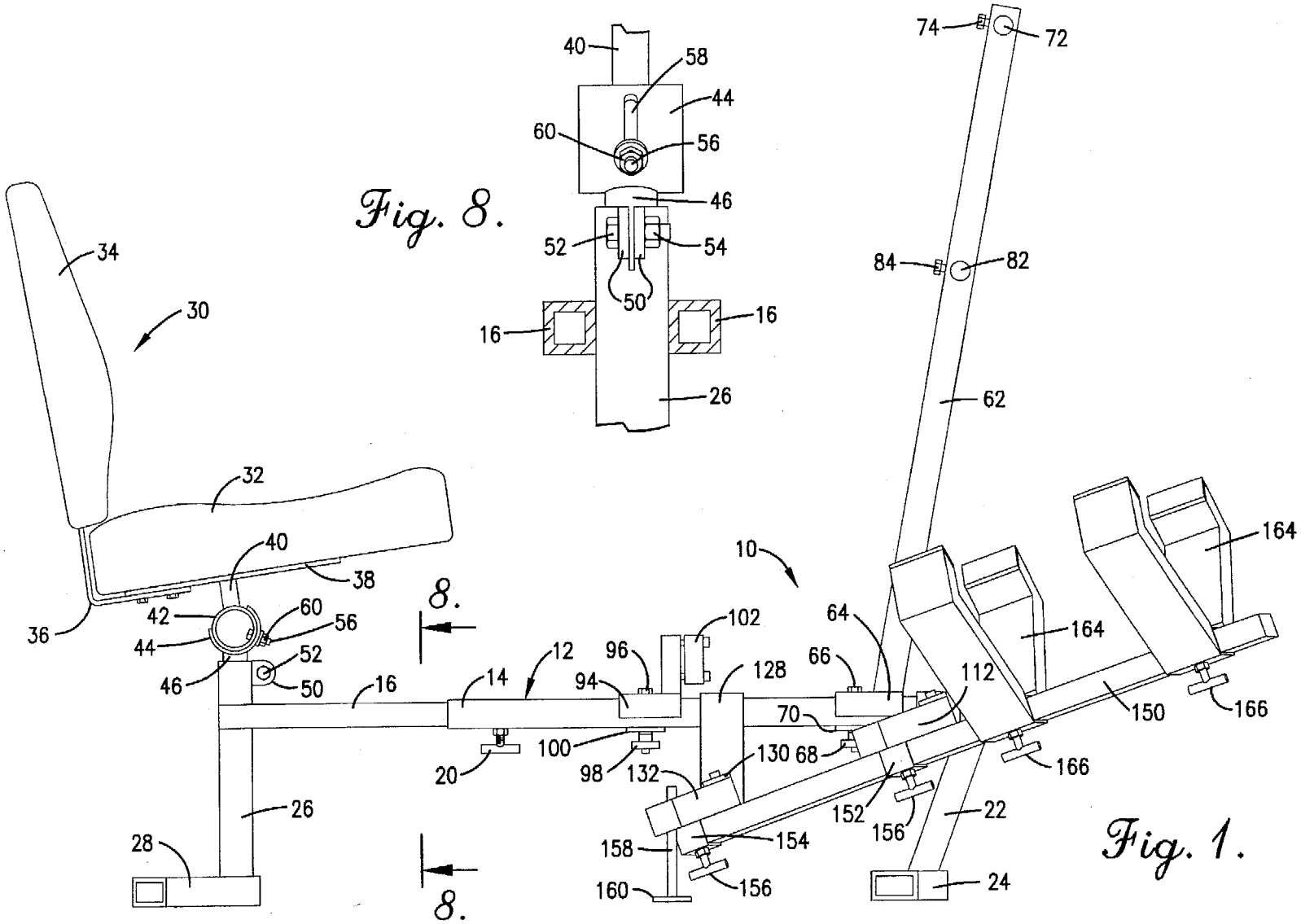
FIG. 1 is a side elevational view of a frame structure which is used to mount both a drummer's seat and various types of drums and drum accessories, with the drums removed from the frame.
FIG. 8 is a fragmentary sectional view on an enlarged scale taken generally along line 8—8 of FIG. 1 in the direction of the arrows.
Figure 2:
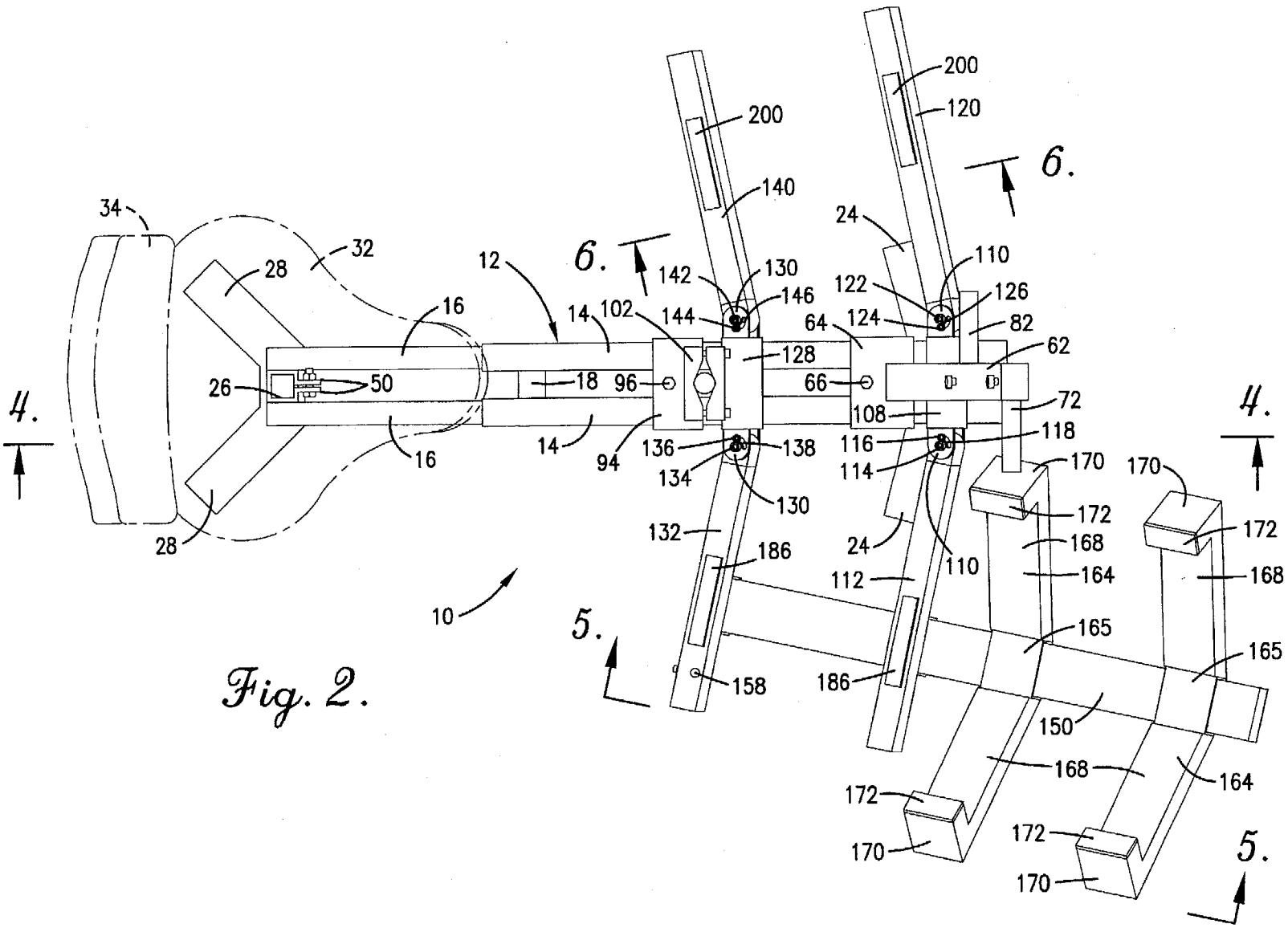
FIG. 2 is a top plan view of the frame shown in FIG. 1.

Referring now to the drawings in more detail and initially to FIGS. 1 and 2, the present invention provides a rigid frame which is generally identified by numeral 10 and which is used for the mounting of musical drums and accessories. The frame 10 includes a horizontal double rail structure generally identified by numeral 12. The rail structure 12 includes a pair of rigid parallel tubes 14 which are square in cross-section and which telescopically receive another pair of slightly smaller square tubes 16. The tubes 16 can be telescoped into and out of tubes 14 in order to adjust the length of the rail structure 12. The tubes 14 are connected near their back ends by a brace 18. As best shown in FIG. 1, a set screw 20 having a Tee handle has a threaded connection with one of the tubes 14 and can be tightened against the corresponding inside tube 16 in order to lock the telescoping tube structures in position. The set screw 20 can be released in order to allow telescopic adjustment of the length of the rail structure 12.

A front leg 22 is secured to the forward ends of the larger tubes 14. Connected with the bottom end of the leg 22 are a pair of feet 24 which extend outwardly in opposite directions. A back leg 26 is secured with the rearward ends of the smaller tubes 16. A pair of feet 28 connect with the lower end of leg 26 and extend outwardly and rearwardly from it. The feet 24 and 28 rest on a floor, stage or other supporting surface and provide a stable bass for the frame 10.

A seat which is generally identified by numeral 30 is mounted on top of the back leg 26. The seat 30 has a contoured seating surface 32 and a back 34. The back 34 is connected with the seating surface 32 by an L-shaped bracket 36 which functions in the manner of a leaf spring. The purpose of the bracket 36 is to allow the seat back 34 to flex enough to accommodate motions drummers typically make in reaching the drums and cymbals during musical performances. By virtue of this type of connection, the seat back 34 may be flexed rearwardly and resists such flexure by reason of the spring action of the bracket 36.

The underside of the seating surface 32 is provided with a plate 38 from which a short post 40 extends downwardly. A ring 42 is carried on the bottom end of the post 40 and is received within a somewhat larger bracket 44 which is complemental in shape to the ring 42. A post 46 extends downwardly from the bracket 44 into the open top end of the back leg 26. As best shown in FIG. 8, the top end of the leg 26 is split and is provided with a pair of lugs 50. A bolt 52 extends between the lugs 50 and receives a nut 54 which may be tightened on the bolt. When the nut 54 is fully tightened, post 46 is locked in place in the split upper end of leg 26, thus securing the seat 30 in a stable position. The height of the seat can be adjusted by loosening the nut 54 and sliding post 46 upwardly or downwardly as desired before again tightening the nut to lock the seat at the desired height.

The ring 42 fits closely within bracket 44 and can rotate therein to adjust the tilt angle of the seating surface 32. A bolt 56 extends from the ring 42 through a slot 58 (see FIG. 8) which is formed through the bracket 44. A nut 60 is threaded onto the bolt 56 and may be tightened to lock the ring 42 to the bracket 44, thus fixing the seat 30 in position with the desired tilt angle of the seating surface 32. In order to adjust the tilt angle of the seat, the nut 60 can be loosened and the ring 42 can be rotated in the desired direction within the bracket 44, as accommodated by the slot 50. When the seat has been adjusted to the desired tilt angle, the nut 60 can be tightened on the bolt 56 to lock the seat in place.

The frame 10 is equipped with a generally upright post 62 which may take the form of a square tube. Preferably, the post 62 angles forwardly somewhat as it extends upwardly away from the rail structure 12. The post 62 is located near the front leg 22 and is connected at its lower end with a slide bracket 64. The slide bracket 64 is received on the tubes 14 and can slide back and forth along the tubes in order to adjust the fore and aft position of the post 62. The post 62 can extend to the floor to create added frame stability. A bolt 66 extends downwardly through the slide bracket at a location between the two tubes 14. A nut 68 with a Tee handle is threaded onto the lower end of the bolt 66 and may be tightened on the bolt against a clamp plate 70 located adjacent to the undersides of the tubes 14. When the nut 68 is tightened, the slide bracket 64 is locked in place on the rail structure 12, thus rigidly securing the post 62 to the frame.

A horizontal pin 72 fits through a passage formed near the upper end of the post 62. The pin 72 extends to one side of post 62 and may be secured by a set screw 74. A drum such as the tom-tom 76 shown in FIG. 4 may be secured to the pin 72 and thus mounted on the post 62. A releasable clamp 78 may be tightened on the pin 72. Extending from the clamp 78 is a mounting arm 80 to which the tom-tom 76 is secured. The angle of the arm 80 is adjustable in order to orient the tom-tom 76 at the desired angle.

Figure 4:
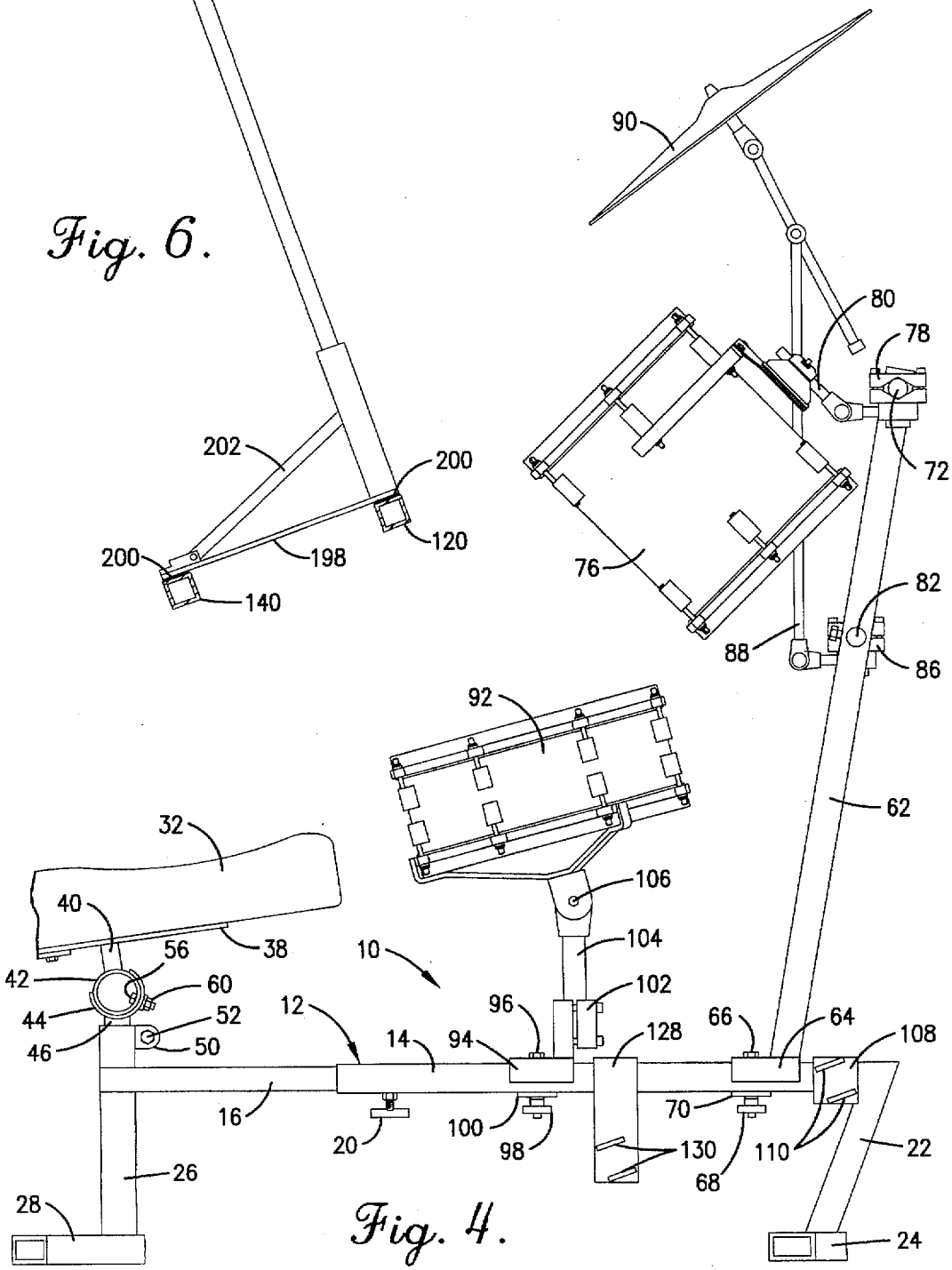
FIG. 4 is a fragmentary sectional view taken generally along line 4—4 of FIG. 2 in the direction of the arrows.

Another horizontal pin 82 extends through a passage formed in the post 62 at an elevation below the upper pin 72. A set screw 84 may be used to secure the pin 82 in place. As best shown in FIG. 4, a suitable clamp 86 may be tightened on the pin 82. A conventional mounting arm 88 for a cymbal 90 extends from the clamp 86. The position and angle of the cymbal 90 can be suitably adjusted through the various adjustments provided by the mounting arm 88. In this fashion, the cymbal 90 is mounted on the post 62 at the desired position and orientation.

A snare drum 92 may be mounted on the rail structure 12. A slide bracket 94 is fitted on the tubes 14 for sliding movement lengthwise on them. A bolt 96 extends through the bracket 94 and receives a Tee handle nut 98 on its bottom end. The nut 98 may be tightened against a clamp plate 100 which engages the undersides of the tubes 14. When the nut 98 is tightened, the slide bracket 94 is locked in place on the tubes 14. A clamp 102 is carried on the bracket 94 and may be clamped to a short post 104 on which the snare drum 92 is mounted and may be angularly adjusted about a horizontal pivot pin 106.

Figure 3:
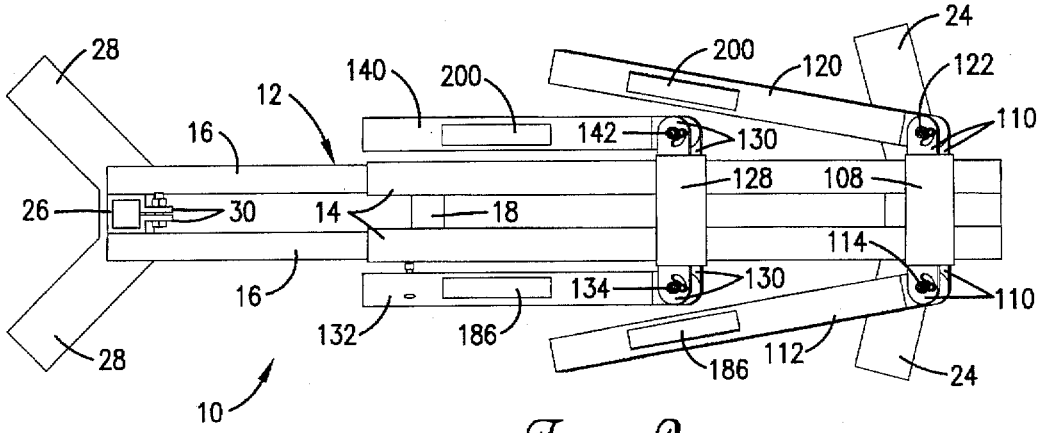
FIG. 3 is a top plan view similar to FIG. 2, but showing the bass drum mounting components removed and the side wings folded alongside the rail structure of the frame to a compact position for storage and/or shipping.

A rigid bracket 108 is secured to the tubes 14 at a location near the front leg 22. The bracket 108 has opposite sides, each of which is provided with a pair of parallel lugs 110. The lugs 110 on one side of the frame receive between them one end of an arm or wing 112 which may take the form of a square tube. A pivot pin 114 which is offset from a vertical orientation pivotally connects the end of the wing 112 between the lugs 110. The wing can pivot about the axis of the pin 114 between the fully extended position shown in FIG. 2 and the fully retracted storage position shown in FIG. 3. A pin 116 which projects from the end of the wing 112 fits in an arcuate slot 118 formed in the top lug 110. The fit of the pin 116 in the slot 118 accommodates the pivotal movement of the wing and limits it in both directions.

Another arm or wing 120 is similarly mounted for pivotal movement to the lugs 110 located on the opposite side of the frame. A pivot pin 122 pivotally connects the end of wing 120 between the lugs 110. A pin 124 extending from the wing is received in an arcuate slot 126 formed in the top lug 110 as previously described for the pin 116 and slot 118. As best shown in FIG. 4, the lugs 110 are located at approximately the elevation of the tubes 14.

A bracket 128 having the shape of an inverted U is secured to the tubes 14 at a location between bracket 108 and the seat 30. The bracket 128 has opposite sides, each of which carries a pair of projecting lugs 130. As best shown in FIG. 4, the lugs 130 are located well below the elevation of the tubes 14.

An arm or wing 132 which may take the form of a square or rectangular tube is pivotally connected at one end between the lugs 130 on one side of the frame. A pivot pin 134 which is offset from a vertical position connects the end of the wing 132 between the lugs and allows the wing 132 to pivot between the fully extended position shown in FIG. 2 and the fully retracted storage position shown in FIG. 3. A pin 136 projecting from the end of wing 132 is received in an arcuate slot 138 formed in the top lug 130 to accommodate pivotal movement of the wing while limiting the extent the wing is allowed to move in both directions. Another arm or wing 140 is pivotally secured by a pin 142 between the lugs 130 on the opposite side of the frame. Pivotal movement of the wing 140 in opposite directions is limited to the positions shown in FIGS. 2 and 3 by the fit of a pin 144 in an arcuate slot 146.

A bass drum 148 is supported on a mounting fixture which includes a bar or beam 150 taking the form of a rectangular tube. The rearward end of the beam 150 fits through a pair of channels 152 and 154 which are secured to the under sides of the wings 112 and 132, respectively. Tee handled set screws 156 have threaded connections with the channels 152 and 154 and may be tightened against the beam 150 to secure it in place relative to the wings 112 and 132. A short post 150 having a flat base 160 forms a stand for the outer end of wing 132. The post fits through the outer end of wing 132 in a manner to slide up and down and may be locked in place relative to the wing by tightening a set screw 162.

The forward end of the beam 150 carries a pair of spaced apart cradles 164 on which the bass drum 148 is carried. Each of the cradles 164 has a central channel 165 through which the beam 150 extends. The cradles can be slid lengthwise on the beam and locked in the desired position thereon by tightening Tee handle set screws 166 which have threaded connections with the channels 165 and may be tightened against the under side of the beam 150.

Figure 7:
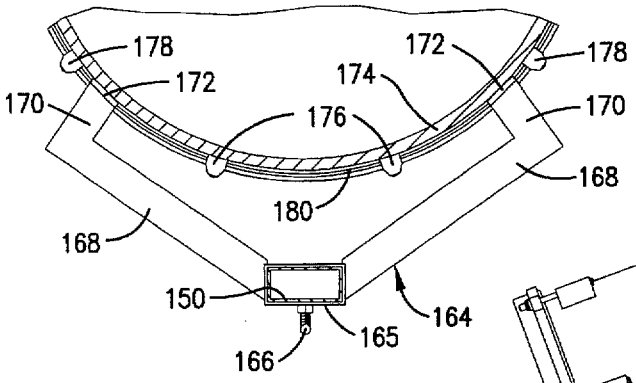
FIG. 7 is a fragmentary sectional view taken generally along line 7—7 of FIG. 5 in the direction of the arrows.

As best shown in FIG. 7, each of the cradles 164 includes a pair of arms 168 which angle upwardly and away from the center channel 165 of the cradle. A short block 170 extends at a right angle from the outer end of each of the arms 168. A mounting pad 172 is carried on the free end of each of the blocks 170.

Figure 5:
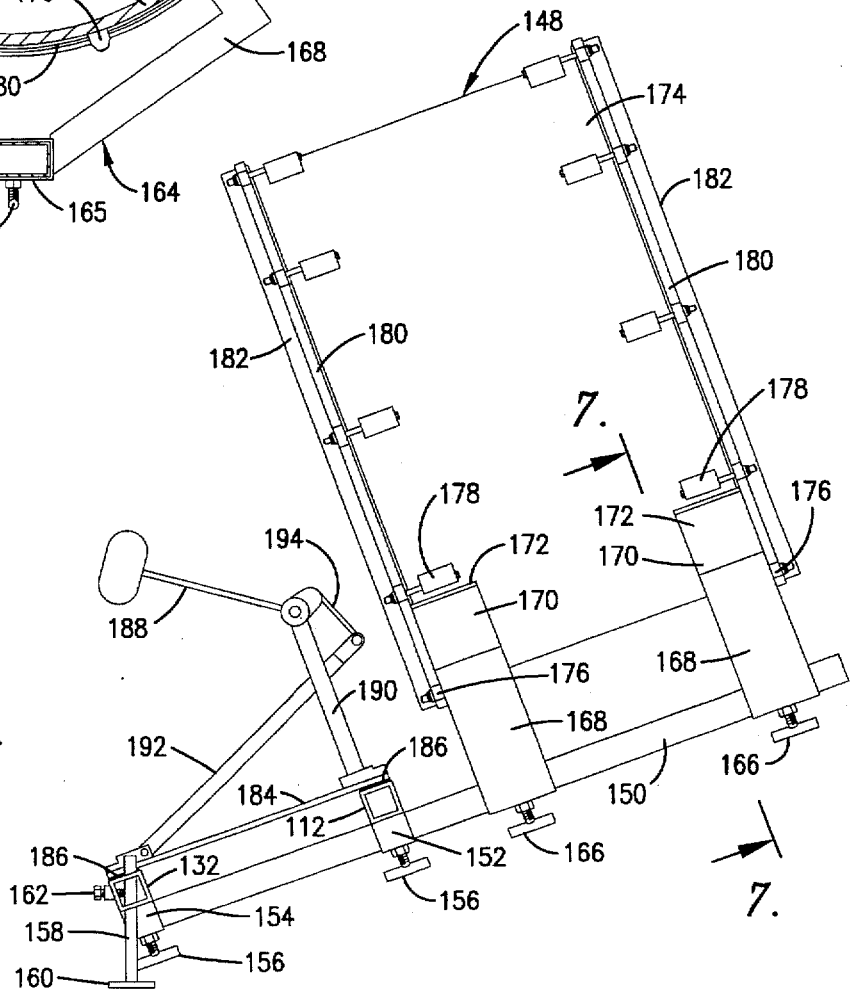
FIG. 5 is a fragmentary elevational view taken generally along line 5—5 of FIG. 2 in the direction of the arrows.

As best shown in FIGS. 5 and 7, the shell 174 of the bass drum rests on the mounting pads 172. The contact between the mounting pads 172 and the drum shell 174 takes place at locations between the two lowermost drum lugs, identified by numeral 176 in FIG. 7, and the next lowermost lugs, identified by numeral 178 in FIG. 7. As best shown in FIG. 5, the locations at which the mounting pads 178 engage the shell 174 are adjacent to the drum rims 180 which tension the drumheads 182 on the bass drum shell 174. These four locations of the points are the points of most resistance in the drum shell. By resting the bass drum 148 at these four locations (the locations of the mounting pads 172), the lowest fundamental pitch of the drum is enhanced, and the low frequency content of the drum sound is increased, thus providing a more focused sound which is desirable both from the standpoint of live performances and recording sessions. This mounting technique also eliminates the need for bass drum spurs of the type that have been prevalent in the past in order to accommodate mounting of the bass drum. The elimination of spurs avoids the need for bulky brackets and for holes drilled in the shell for mounting of the spurs, both of which detract from the sound of the drum.

A pedal actuated system is provided for playing of the bass drum 148. With particular reference to FIG. 5, a base plate 184 is mounted to extend between the two wings 112 and 132 at a location directly in front of the center of the bass drum 148. Hook and loop type fastening strips 186 may be used to mount the plate 184 to the wings 112 and 132. A pedal actuated drum stick 188 is mounted for pivotal movement on top of a stand 190 which extends upwardly from the front end of the plate 184. A pedal 192 is pivotally secured at its heel end with the rear edge portion of the plate 184. The forward end of the pedal is connected with a crank mechanism 194 that operates in a conventional manner to pivot the stick 188 against the adjacent batter head 182 of the drum when the pedal 192 is depressed.

It is noted that the adjustability of the cradles 164 along the beam 150 allows the elevation and the fore and aft position of the bass drum 148 to be adjusted. Consequently, the components can be adjusted so that the stick 188 strikes the batter head 182 to exactly in the center in order to enhance the drum sound. The distance from the pedal beater to the drumhead can also be varied to effect the most advantageous feel in the "swing" of the pedal beater shaft. By striking the head in the dead center position, the most dominating fundamental pitch is produced from the drum. At the same time, the "feel" of the pedal is not compromised by adjustment of the path length of the stick 188.

Figure 6:
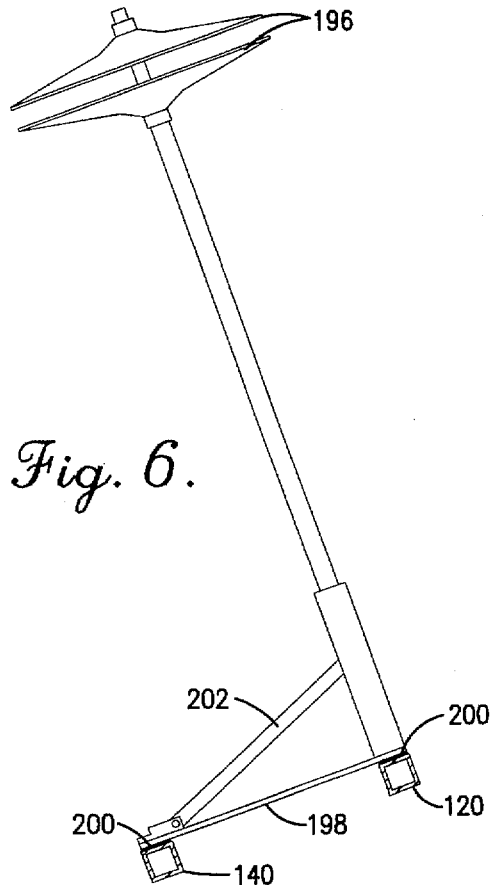
FIG. 6 is a fragmentary sectional view taken generally along line 6—6 of FIG. 2 in the direction of the arrows.

Referring now to FIG. 6 in particular, the other wings 120 and 140 are used to mount a set of pedal operated cymbals 196. A base plate 198 is secured on top of the wings 120 and 140 by hook and loop type fastening strips 200 or another suitable means. The heel end of a pedal 202 is pivotally secured to the back edge portion of the plate 198. The cymbals 196 are mounted in a conventional manner such that the upper cymbal 196 is pulled downwardly to strike the lower cymbal 196 when the pedal 202 is depressed.

In use, the frame 10 is set up in the desired manner with all of the drum components mounted on the frame and adjusted to the positions and orientations which are most comfortable to the drummer. The seat 30 is adjusted to the desired height and tilted to the desired angle. The tilted orientation of the seating surface 32 allows the drummer to assume a recumbent position for playing of the drums. The tom-tom 76 can be adjusted to the desired elevation and angle of inclination, as can be high hat cymbal 90. By adjustment of the slide bracket 64, the drum 76 and cymbal 90 can also be adjusted toward and away from the seat 30. Likewise, the snare drum 92 may be adjusted lengthwise along the frame 10 and may be adjusted as to its height and tilt angle. The seat 30 may be adjusted as to its position relative to the tubes 14 by telescoping tubes 16 inwardly and outwardly of tubes 14 before locking the rail structure in place by tightening of the set screw 20.

The bass drum 148 may be adjusted by pivoting the wings 112 and 132 to the desired angular position. By adjusting the pivotal position of the wings 112 and 132, the position of the foot pedal 192 both radially relative to the pivot axes of the wings and as to its distance away from the drummer can be adjusted as desired. The cradle arm 168 can be adjusted or replaced with another arm that will change the bass drum elevation. This will effect the position of the beating spot at the drumhead as well as to accommodate different bass drum sizes by circumference. The adjustability of the stand 158 accommodates this elevational adjustment. The bass drum 148 can also be adjusted as to its elevation so that the stick 188 strikes it at a dead center position, as the cradles 164 can be adjusted along the length of the beam 150 in order to vary the elevation of the center position of the bass drum.

The drums and accessories are played by the drummer seated on the seat 30 in a recumbent position. The recumbent position is both more comfortable and more ergonomical than a conventional seated position, as pressure is taken off the lower back as a result of the recumbent posture assumed by the drummer. At the same time, all of the drums and cymbals can be easily reached without the need to reach forward and apply undue pressure on the back and shoulders. The result is that there is less muscular discomfort, less chance of back problems, increased acuity to the extremities (allowing more expression in the subtleties of musical performance) and better circulation than in the case of a drummer seated in a conventional position.

It is a particularly important feature of the invention that the seat 30 is rigidly connected with all of the drums and accessories through the rigid frame 10. As a consequence, the vibration of the drums is transmitted through the frame to the seat to provide the drummer with feedback as to the vibrations and providing him with an enhanced "feel" of the drums. Additionally, each of the drums provides vibrations through the frame that are transmitted to the other drums, and the overall effect is one in which the different drums interact more completely with one another and thereby provide a unitary sound which can be sensed by the drummer due to his position on the seat 30. The frame 10 is preferably constructed of metal.

When the drum set is to be stored or shipped to a different location, the drums and cymbals can be removed from the frame and packed in the usual manner. The beam 150 can be removed from the wings 112 and 132, and the cradles 164 can be removed from the beam 150 for more compact storage. The plates 184 and 198 can be detached from the wings, and the wings can then be folded inwardly to the storage position shown in FIG. 3. In this position, all of the wings lie generally alongside the double beam structure 12, and the frame presents a compact configuration for easy storing or shipping. The seat 30 can be removed, and the tubes 16 can be retracted as far as desired into the larger tubes 14 to minimize the overall length of the frame.

It is thus evident that the drum set can be broken down and can be stored and/or transported in a compact configuration. This assembly can be quickly and easily carried out. Conversely, the drums can be set up at a new location without great difficulty or time consumption. In addition, because of the actual physical connection of the drummer with the drums he is playing, a completely new concept in the playing of drums is provided by the present invention. In addition to the enhanced feedback and feel provided through utilization of the rigid frame 10, the drummer is able to play the drums more comfortably and effectively due to the recumbent position he assumes while playing the drums from the seat 30.

In addition to or alternatively to the acoustical drums and drum accessories specifically shown and described, the frame apparatus of the present invention can accommodate other equipment used by drummers for practice or performances. For example, rebounding playing surfaces such as rubber pads commonly used for silent practicing by drummers or electronic trigger pads that are commonly used to trigger electronic drum sounds may be mounted on the frame 10. Likewise, the pedals for playing the bass drum can be replaced by electronic foot boards to trigger electronic sounds. The present invention contemplates use of the frames 10 to mount these types of rebounding playing surfaces as well as more conventional acoustic drums.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described the invention, what is claimed is:

1. A musical assembly comprising:

a rigid frame;

a seat mounted on said frame in a manner to receive vibration transmitted to the frame;

a pair of spaced apart arms extending to one side of said frame;

a bar connected rigidly with both of said arms;

at least one rebounding playing surface comprising a bass drum having a shell;

cradle means carried on said bar for holding said bass drum, said cradle means engaging said shell at spaced locations thereon;

a pedal connected with said arms at a location accessible to the foot of a drummer seated on said seat; and a beater stick actuated by said pedal for striking said bass drum.

2. A musical assembly as set forth in claim 1, wherein said seat is mounted on said frame at a tilted orientation to accommodate a user in a recumbent position thereon.

3. A musical assembly as set forth in claim 2, including means for adjusting the angle at which said seat is tilted.

4. A musical assembly as set forth in claim 1, including:

a generally upright post member mounted on said frame at a location spaced from said seat; and means for mounting said one rebounding playing surface on said post member.

5. A musical assembly as set forth in claim 4, including means for mounting a cymbal on said post member.

6. A musical assembly as set forth in claim 4, including means for adjusting the distance between said seat and post member.

7. A musical assembly as set forth in claim 4, wherein said one rebounding playing surface comprises an acoustic drum, and including means for mounting a second acoustic drum on said frame at a location between said seat and post member.

8. A musical assembly as set forth in claim 7, including:

a bass drum;

means for mounting said bass drum on said frame at a preselected location;

a pedal mounted on said frame adjacent said bass drum at a location to receive the foot of a drummer seated on said seat; and a beater stick actuated by said pedal for striking said bass drum.

9. A musical assembly as set forth in claim 1, including means for detaching said bar from said arms.

10. A musical assembly comprising:

a rigid frame adapted to stand on a support surface;

means for mounting a plurality of rebounding playing surfaces on said frame;

a seat adapted to support a user seated thereon, said seat having a seating surface and a seat back extending generally upwardly from a back portion of the seating surface; and means for mounting said seat on the frame in a manner orienting the seating surface to incline downwardly from front to back with the seat back located at an incline to receive and support the back of a user seated on the seating surface in a recumbent position thereon, said mounting means situating said seat at a location and orientation allowing a user seated on said seating surface to play the playing surfaces in said recumbent position.

11. A musical assembly comprising:

a rigid frame adapted to rest on a support surface, said frame having front and back legs and a generally horizontal rail structure supported on said legs;

a seat mounted on said frame at a location adjacent to said back leg and adapted to support a user in a seated position thereon;

a generally upright post member mounted on the frame in extension upwardly therefrom, said post member being connected with said frame in a manner to transmit vibration thereto;

means for mounting a rebounding playing surface on said post member at a location to be played by a user seated on said seat;

a bass drum having a batter head and a shell;

a pair of arms connected with said rail structure and extending generally sidewardly therefrom;

a bar connected rigidly with both of said arms;

cradle means on said bar for holding said bass drum, said cradle means engaging said shell at spaced apart locations thereon;

a pedal connected with said arms at a location to receive the foot of a drummer seated on said seat; and a beater stick actuated by said pedal for striking said batter head.

12. A musical assembly as set forth in claim 11, including:

means for detachably connecting said bar with said arms;

means for detachably connecting said pedal with said arms; and means for pivotally connecting each of said arms with said rail structure to allow each arm to be folded alongside said rail structure for storage.

13. A musical assembly as set forth in claim 12, including:

a set of cymbals;

a second pair of arms pivotally connected with said rail structure to allow each arm in said second pair to be folded alongside said rail structure for storage, said second pair of arms normally extending sidewardly from said rail structure from a side thereof opposite a side from which said arms in the first mentioned pair extend; and a pedal for actuating said set of cymbals detachably mounted on said second pair of arms at a location to receive a foot of a user seated on said seat.

14. A musical assembly as set forth in claim 13, including means for adjusting the distance between each of said arms and said seat.

15. A musical assembly as set forth in claim 11, wherein said rail structure includes:

a first pair of rigid tubes connected with said front legs;

a second pair of rigid tubes connected with said back legs, said first pair of tubes having a telescopic fit with said second pair of tubes; and releasable means for locking said first and second tubes against telescopic movement relative to one another.

16. A musical assembly as set forth in claim 11, including means for adjusting the location of said post member along said rail structure.

17. A musical assembly as set forth in claim 11, wherein said playing surface comprises an acoustic drum, and including:

a second acoustic drum; and means for mounting said second acoustic drum on said rail structure at a location between said seat and post member.

18. A musical assembly as set forth in claim 11, including:

means for mounting said seat on said frame in a manner allowing the seat to assume a tilted position to accommodate a user seated thereon in a recumbent position; and means for adjusting the tilt angle of said seat.

19. A musical assembly comprising:

a rigid frame;

at least one rebounding playing surface mounted on said frame in a manner to transmit vibration from the playing surface to the frame when the playing surface is played; and a seat mounted on said frame in a manner to receive vibration transmitted to the frame when the playing surface is played, said seat having a seating surface tilted downwardly from front to back and a seat back on a back portion of said seating surface for receiving and supporting the back of a user seated on said seating surface in a recumbent position at a location to play the playing surface.

* * * * *